US011952869B1

(12) United States Patent
Zhang et al.

(10) Patent No.: US 11,952,869 B1
(45) Date of Patent: Apr. 9, 2024

(54) HIGH-EFFICIENCY YIELD-INCREASING EXPLOITATION METHOD FOR NATURAL GAS HYDRATES

(71) Applicants: CHINA UNIVERSITY OF PETROLEUM (EAST CHINA), Qingdao (CN); SHANDONG PENGBO SAFETY AND ENVIRONMENTAL PROTECTION SERVICE CO., LTD., Yantai (CN)

(72) Inventors: Jianbo Zhang, Qingdao (CN); Zhiyuan Wang, Qingdao (CN); Yuting Wang, Qingdao (CN); Baojiang Sun, Qingdao (CN); Jie Zhong, Qingdao (CN); Jihao Pei, Qingdao (CN); Nan Ma, Qingdao (CN); Xueqi Liu, Qingdao (CN); Junjie Hu, Qingdao (CN)

(73) Assignees: CHINA UNIVERSITY OF PETROLEUM (EAST CHINA), Qingdao (CN); SHANDONG PENGBO SAFETY AND ENVIRONMENTAL PROTECTION SERVICE CO., LTD., Yantai (CN)

( * ) Notice: Subject to any disclaimer, the term of this patent is extended or adjusted under 35 U.S.C. 154(b) by 0 days.

(21) Appl. No.: 18/341,816

(22) Filed: Jun. 27, 2023

(30) Foreign Application Priority Data

Sep. 13, 2022 (CN) ..... 202211106650.5

(51) Int. Cl.
*E21B 41/00* (2006.01)
*E21B 7/04* (2006.01)
(Continued)

(52) U.S. Cl.
CPC ..... *E21B 41/0099* (2020.05); *E21B 7/046* (2013.01); *E21B 33/138* (2013.01);
(Continued)

(58) Field of Classification Search
CPC .... E21B 41/0099; E21B 7/046; E21B 33/138; E21B 43/24; E21B 43/26; E21B 43/305; E21B 49/00
See application file for complete search history.

(56) References Cited

U.S. PATENT DOCUMENTS 5,868,202 A * 2/1999 Hsu ..... E21B 43/305 405/265
6,158,517 A 12/2000 Hsu
(Continued)

FOREIGN PATENT DOCUMENTS

CA 2760312 A1 6/2012
CN 102165138 A 8/2011
(Continued)

OTHER PUBLICATIONS

Cai Jianchao;Xia Yuxuan;Xu Sai; Tian Haitao; Research progress on multiphase seepage characteristics of hydrate containing sediment Journal of Mechanics, vol. 52, Issue 01 pp. 208-223, Nov. 18, 2020.

(Continued)

*Primary Examiner* — Daniel P Stephenson
(74) *Attorney, Agent, or Firm* — CBM PATENT CONSULTING, LLC

(57) ABSTRACT

A high-efficiency yield-increasing exploitation method for natural gas hydrates includes steps of drilling of natural gas hydrate reservoirs along horizontal wells, seepage increasing by fracturing for fracture forming and stability improvement by grouting in the natural gas hydrate reservoirs, and yield improvement by combined exploitation of depressurization of the horizontal wells and heat injection; according to the present invention, drilling time is shortened by rapid drilling along the horizontal wells, the permeability of the reservoirs can be effectively improved by fracturing for fracture forming, the stability of the reservoirs can be improved by injecting foam cement slurry into the reservoirs, and the yield of the natural gas hydrates can be improved by the combined exploitation method of depressurization of the horizontal wells and heat injection.

9 Claims, 1 Drawing Sheet

(51) Int. Cl.

| | |
|---|---|
| ***E21B 33/138*** | (2006.01) |
| ***E21B 43/24*** | (2006.01) |
| ***E21B 43/26*** | (2006.01) |
| ***E21B 43/30*** | (2006.01) |
| ***E21B 49/00*** | (2006.01) |

(52) U.S. Cl.
CPC ..... *E21B 43/24* (2013.01); *E21B 43/26* (2013.01); *E21B 43/305* (2013.01); *E21B 49/00* (2013.01)

(56) References Cited

U.S. PATENT DOCUMENTS

| | | | | |
|---|---|---|---|---|
| 7,441,603 | B2 * | 10/2008 | Kaminsky | E21B 43/26 166/371 |
| 11,434,740 | B1 * | 9/2022 | Ngyuen | E21B 43/26 |
| 2023/0142443 | A1 * | 5/2023 | Zhou | C09K 8/72 166/308.2 |

FOREIGN PATENT DOCUMENTS

| | | | | |
|---|---|---|---|---|
| CN | 107420083 | A | | 12/2017 |
| CN | 107542439 | A | | 1/2018 |
| CN | 107542441 | A | * | 1/2018 |
| CN | 107575197 | A | | 1/2018 |
| CN | 107575201 | A | | 1/2018 |
| CN | 107676061 | A | * | 2/2018 |
| CN | 108180001 | A | | 6/2018 |
| CN | 108590595 | A | | 9/2018 |
| CN | 111827936 | A | | 10/2020 |
| CN | 112901121 | A | | 6/2021 |
| CN | 113669041 | A | | 11/2021 |
| CN | 114396255 | A | | 4/2022 |
| CN | 114718520 | A | | 7/2022 |

OTHER PUBLICATIONS

Li Yanlong; Liu Lele; Liu Changling;Sun Jianye;Ye Yuguang;Chen Qiang; Sand production and sand control issues during the extraction of natural gas hydrates Frontiers of Marine Geology, vol. 32, Issue 07 pp. 36-43, Jul. 28, 2016.

* cited by examiner

HIGH-EFFICIENCY YIELD-INCREASING EXPLOITATION METHOD FOR NATURAL GAS HYDRATES

CROSS-REFERENCE TO RELATED APPLICATIONS

This application claims priority to Chinese Patent Application Ser. No. CN2022111066505 filed on 13 Sep. 2022.

FIELD OF THE INVENTION

The present invention relates to a high-efficiency yield-increasing exploitation method for natural gas hydrates, and belongs to the technical field of the exploitation of the natural gas hydrates.

BACKGROUND OF THE INVENTION

Natural gas hydrates are anew clean and efficient energy with huge reserves. According to incomplete statistics, organic carbon reserves in natural gas hydrates are twice as large as those of fossil energy, such as oil gases, around the world. Due to the shallow depth of burying storage, poor cementation, poor permeability, non-stratified rock properties, and other characteristics in the majority of natural gas hydrate reservoirs, the conventional exploitation method of oil gases is unable to be suitable for the exploitation of the natural gas hydrate reservoirs. In order to more efficiently exploit the natural gas hydrates in the reservoirs, researchers have, in recent years, proposed a variety of different exploitation methods, including a depressurization method, a heat injection method, an inhibitor injection method, a carbon dioxide replacement method, a solid-fluidization method, and the like.

The depressurization method is such a method that the pressure in the reservoirs is reduced via control over the bottom pore pressure of exploitation wellholes, the original exploitation condition of the natural gas hydrates therein is destroyed, and the natural gas hydrates are forcedly decomposed into methane gases and water for the recovery of the methane gases. The heat injection method is such a method that heat is injected into the reservoirs to elevate the temperature of the reservoirs, the original exploitation condition of the natural gas hydrates therein is destroyed, and the natural gas hydrates are forcedly decomposed into methane gases and water for the recovery of the methane gases. The inhibitor injection method is such a method that the temperature at which the hydrates are stabilized is reduced by injecting thermodynamic inhibitors of the hydrates into the reservoirs, or the original equilibrium condition in the reservoirs is destroyed under the increased pressure. The carbon dioxide replacement method is such a method that methane in methane hydrates is replaced by injecting carbon dioxide which is prone to produce hydrates into the reservoirs to recover the methane gases therefrom. The solid-fluidization method is such a method that hydrate-containing non-stratified rock deposit sediments are crushed into fine granules via seabed exploitation, and mixed with seawater, and the mixture is lifted to a platform for further processing along a closed pipeline.

In the existing method, the depressurization method has the advantages of high gas recovery rate, easiness in operation, low costs, and the like, which is called a preferred method for most possibly achieving the commercial exploitation of the natural gas hydrates in the future. However, during the exploitation of the natural gas hydrates, the decomposition of the natural gas hydrates in the reservoirs will further weaken the cementation of the reservoirs, and the reservoirs are compacted under the action of overburden pressure to reduce the permeability, which severely affects the high-efficiency exploitation of the natural gas hydrates. Meanwhile, the current exploitation method still has the defect of low yield, and the commercial exploitation condition of the natural gas hydrates hasn't been reached yet.

In conclusion, the high-efficiency yield-increasing exploitation method of the natural gas hydrates hasn't been found yet, which is a key difficulty that restricts the commercial exploitation of the natural gas hydrates. Therefore, the present invention is provided.

SUMMARY OF THE INVENTION

Aiming at the defects in the prior art, and especially for difficulties of low yield, short time of duration, and poor economic efficiency during the exploitation of the natural gas hydrates, the present invention provides a high-efficiency yield-increasing exploitation method of natural gas hydrates, in which the seepage capability and stability of reservoirs are improved by fracturing of horizontal wells for fracture forming and the injection of foam cement slurry, and the exploitation yield of the natural gas hydrates is improved by an exploitation method of depressurization+heat injection, which provides a guarantee for achieving the commercial exploitation of the natural gas hydrate reservoirs across the sea area in the future.

In the present invention, the following technical solutions are as follow:

A high-efficiency yield-increasing exploitation method for natural gas hydrates includes the following steps:

(1) drilling of natural gas hydrate reservoirs along horizontal wells as for the natural gas hydrate reservoirs, well arrays are drilled in an exploratory trench drilling manner along the horizontal wells, each of which includes three horizontal wells: a first horizontal well, and a second horizontal well and a third horizontal well positioned on two sides of the first horizontal well, and each of the horizontal wells includes a vertical well section, an inclined well section, and a horizontal well section, by the exploratory trench drilling manner, the drilling efficiency of single wells may be improved, and the drilling operation along the horizontal wells may increase a contact area between an exploitation wellhole and the reservoirs to improve the exploitation yield of the natural gas hydrates.

(2) seepage increasing by fracturing for fracture forming and stability improvement by grouting in the natural gas hydrate reservoirs After the drilling operation is completed, fracturing for fracture forming at the horizontal well section of the first horizontal well is implemented, a seawater fracturing fluid is injected into the first horizontal well, and flows into the natural gas hydrate reservoirs along the horizontal well section, so that fractures are formed in the hydrate reservoirs between the first horizontal well and the second horizontal well, and between the first horizontal well and the third horizontal well to improve the permeability of such reservoirs, and then, foam cement slurry is injected into the horizontal well section of the first horizontal well, is distributed all over the natural gas hydrate reservoirs, and is cured for forming for a period of time, thereby improving the stability of the hydrate reservoirs, and finally, a resin or oligomer chemical sand control agent which is commonly used in the art is injected into a periphery of the well to reduce or avoid a sand production rate during an exploitation of the natural gas hydrates at the later period and improve the safety of the natural gas hydrates in exploitation;

and in this step, the first horizontal well is designed as a fracturing well; the horizontal well section of the first horizontal well is fractured only in order to maintain the stability of the wellhole; seawater which is convenient to obtain, sufficient in supply, and low in costs serves as the fracturing fluid, with a fracturing pressure thereof being larger than a fracture forming pressure of the hydrate reservoirs, and the seawater fracturing fluid flows into the hydrate reservoirs along the horizontal well section of the first horizontal well, forming the fractures in the hydrate reservoirs between the first horizontal well and the second horizontal well and between the first horizontal well and the third horizontal well to improve the permeability of such reservoirs.

(3) Yield improvement by combined exploitation of depressurization of the horizontal well and heat injection The exploitation yield of the natural gas hydrates may be improved by the combined exploitation method of depressurization of the horizontal well and heat injection; and in order to reduce the exploitation costs of the natural gas hydrates, seawater is injected into the natural gas hydrate reservoirs along the first horizontal well at a temperature of more than 60° C. to elevate the temperature of the reservoirs, and meanwhile, a bottom pore pressure of the second horizontal well and the third horizontal well is reduced; and a decomposition rate of the natural gas hydrates in the reservoirs is improved under the collaborative action of the two operations.

According to the above-mentioned technical solution, drilling time is shortened by rapid drilling along the horizontal well, the permeability of the reservoirs may be effectively improved by fracturing for fracture forming, the stability of the reservoirs may be improved by injecting foam cement slurry into the reservoirs, and the yield of the natural gas hydrates may be improved by the combined exploitation method of depressurization of the horizontal well and heat injection. The method has the advantages of reducing drilling costs, improving the permeability of the reservoirs, enhancing the stability of the reservoirs, improving the gas recovery efficiency and the like.

According to the present invention, preferably, in step (1), in view of an upper stratum above the deep-water natural gas hydrate reservoirs, featuring shallow depth, softness, and looseness, an exploratory trench cycle drilling manner is available, that is, a wellhole of the drilled well at a seawater section is not provided with a water-proofing pipe, and a drilling fluid returning from an annular space of a wellhole of the drilled well at a stratum section and rock debris carried thereby are discharged to a seabed at a mud line; and by the exploratory trench cycle drilling manner, a drilling rate may be improved significantly, a drilling cycle may be shortened, drilling costs may be reduced, and safety risks arising from closed cycle drilling may be avoided. Meanwhile, the drilled well is designed as the horizontal well, and as a wellhole of the horizontal well may be obviously longer than that of a vertical well, a contact area between the exploitation wellbore and the reservoirs may be increased to lay a foundation for improving the yield of the natural gas hydrate during exploitation at the later period. During drilling every time, a total of 3 horizontal wells are provided, which constitute a well array. During exploitation, if the site condition (larger hydrate enrichment regions, and closer distance among regions) satisfies the condition, multiple well arrays may be used for combined exploitation; and if the site condition (smaller hydrate enrichment regions, and farther disperse distance) does not satisfy the condition, single-well exploitation may also be implemented, that is, the exploitation of one well array is completed before the exploitation of the next well array. A distance among multiple well arrays may be calculated with formulas (1)-(4).

Preferable, in step (1), an interval among different horizontal wells may be determined by the following method:

Firstly, based on a Darcy's law, a pressure distribution in the natural gas hydrate reservoirs may be as follows:

$$P_2 = P_1 + \frac{Q \cdot \mu \cdot L}{K \cdot A} \tag{1}$$

where $P_1$ is a bottom pore pressure of the horizontal wells, MPa; $P_2$ is a pressure in the natural gas hydrate reservoirs, MPa; Q is a flow in pores of the natural gas hydrate reservoirs, $m^3/s$; μ is a fluid viscosity in the reservoirs, mPa·s; L is a seepage radius of a fluid in the reservoirs, m; K is an absolute permeability of the natural gas hydrate reservoirs, mD; A is a sectional area of seepage flow of the natural gas hydrate reservoirs, $m^2$;

then, in order to achieve a decomposition of the natural gas hydrates during an exploitation of the natural gas hydrates under reduced pressure, the pressure $P_2$ in the reservoirs needs to conform to the following criteria:

$$P_2 \le P_e = 10^6 \exp\left(\sum_{n=0}^{5} a_n (T + \Delta T_d)^n\right) \tag{2}$$

where $$\begin{cases} a_0 = -1.94138504464560 \times 10^5 \\ a_1 = 3.31018213397926 \times 10^3 \\ a_2 = -2.25540264493806 \times 10^1 \\ a_3 = 7.67559117787059 \times 10^{-2} \\ a_4 = -1.30465829788791 \times 10^{-4} \\ a_5 = 8.86065316687571 \times 10^{-8} \end{cases} \tag{3}$$

where T is a reservoir temperature, K; $\Delta T_d$ is a temperature at which a decline in a hydrate equilibrium is caused by a thermodynamic hydrate inhibitor, K;

$\Delta T_d$ may be obtained by the following formula through calculation:

$$\Delta T_d = \Delta T_{d,r} \frac{\ln(1 - x)}{\ln(1 - x_r)} \tag{4}$$

where x is a molar fraction of the thermodynamic hydrate inhibitor in a water phase, which is dimensionless; $x_r$ is a reference molar fraction of the thermodynamic hydrate inhibitor in the water phase, which is dimensionless; $\Delta T_{d,r}$ is a temperature at which the decline in the hydrate equilibrium is caused under the molar fraction of the thermodynamic hydrate inhibitor as $x_r$, K; and an interval ($L_1$=L) between every two horizontal wells is solved according to formulas (1)-(4), based on which the layout of the three horizontal wells is supported theoretically.

In formulas (3) and (4), the thermodynamic hydrate inhibitor is the seawater, and the seawater, containing salinity, belongs to a salt-based thermodynamic hydrate inhibitor.

Preferably, in step (2), during fracturing, a fracturing pressure is larger than a fracture forming pressure of the natural gas hydrate reservoirs.

Preferably, in step (2), a preparation process of the foam cement slurry is as follows:

a certain mass of cement is mixed with water to form cement slurry, and a certain mass of foaming agent and foam stabilizer are added to the cement slurry with stirring until fine and stable bubbles which are independent of each other are formed, and the foam cement slurry with low density and high permeability may be formed, with a density thereof being less than 1.0 g/cm$^3$, which needs, however, to be determined according to actual design and requirements on site, that is, $\rho_{gfc}$ in the formula (5). The construction method is readily available, without arranging any additional equipment, and the formed foam cement slurry has the advantages of stable properties, high compressive strength, low costs, and the like. What there will be to adopt in the construction method is thinner foam cement slurry. This may improve the liquidity of the foam cement slurry in the reservoirs, making it distributed all over the pores of the reservoirs better.

In the preparation of the foam cement slurry, according to the properties of the required foam cement slurry and a mix proportioning principle thereof, the using amount of the cement is as follows:

$$M_{sn} = \frac{V_{gfc} \cdot \rho_{gfc}}{s_a} \tag{5}$$

where $M_{sn}$ is the using amount of the cement, kg; $\rho_{gfc}$ is the design dry density of the foam cement, kg/m$^3$; $V_{gfc}$ is the volume of the dry foam cement, m$^3$; $S_a$ is a mass coefficient, which is dimensionless, wherein it is 1.2 for ordinary Portland cement, and 1.4 for sulfate cement;

water supply volume:

$$M_w = \alpha \cdot M_{sn} \tag{6}$$

where $M_w$ is the water supply volume; a is a basic ratio of water to materials, which is dimensionless;

the using amount of the foaming agent:

$$M_p = \frac{V_{py} \cdot \rho_{py}}{b+1} \tag{7}$$

where $M_p$ is the mass of the foaming agent in the foam cement slurry, kg; $V_{py}$ is the volume of a foam concentrate formed from the foaming agent, $m_3$; $\rho_{py}$ is the density of the foam concentrate formed from the foaming agent, kg/m$^3$; b is the times of foaming of the foaming agent, which is dimensionless; and the using amount of the foam stabilizer is half of that of the foaming agent.

Preferably, in step (2), an injection rate of the foam cement slurry is as follows:

$$V_{fc} \geq 2L_1 \cdot L_2 \cdot H \cdot S_f \tag{8}$$

where $V_{fc}$ is a volume of the foam cement slurry to be injected into the natural gas hydrate reservoirs, m$^3$; $L_2$ is a length of the horizontal well section, m; H is a thickness of the natural gas hydrate reservoirs, m; and $S_f$ is a porosity of the natural gas hydrate reservoirs subjected to fracturing for fracture forming, which is dimensionless.

Preferably, the foaming agent is preferably sodium dodecyl sulfate, and the foam stabilizer is preferably laurinol.

Preferably, in step (2), during the injection of the foam cement slurry into the horizontal well section of the first horizontal well, when it is found that there is the foam cement slurry in the second horizontal well and the third horizontal well, the injection of the foam cement slurry may be stopped, and meanwhile, the foam cement slurry is removed rapidly from the second horizontal well and the third horizontal well, that is, clear water may be injected into drill stems in the second horizontal well and the third horizontal well, the foam cement slurry carried thereby returns upwards from an annular space between the drill stems and drivepipes to fulfill the objective of cleaning; and then, each of the horizontal wells is shut in for 48 h, until the foam cement slurry injected into the natural gas hydrate reservoirs is cured for forming, which may improve the stability of the reservoirs during the exploitation of the natural gas hydrates and reduce risks of the collapse and sand production of the natural gas hydrate reservoirs.

Preferably, in step (3), the pressure distributed in the reservoirs is reduced by controlling a pressure decay amplitude at the bottoms of the second horizontal well and the third horizontal well, so that the natural gas hydrates in the reservoirs are decomposed into gases and water, and meanwhile, and the gases flow into the second horizontal well and the third horizontal well under a differential pressure for recovery.

In order to solve the problem of the secondary generation of the hydrates due to the rapid decomposition of the natural gas hydrates for a short time in the reservoirs, a relationship between absorption of heat from the decomposition of the hydrates and a heat transfer around the reservoirs is coordinated by controlling the bottom pore pressure of the second horizontal well and the third horizontal well with a multi-stage step-by-step depressurization strategy, that is, the pressure decay amplitude at the bottoms of the wells is reduced slowly after the bottom pore pressure is reduced to a hydrate phase equilibrium condition in decomposition, and with every 0.5 MPa of the bottom pore pressure declining, a bottom pore pressure value is maintained until a gas recovery rate declines significantly before the depressurization of the next step, thereby fulfilling the objective of reducing or avoiding the secondary generation risk of the hydrates in the reservoirs.

A method for reducing the bottom pore pressure is as follows:

Before the exploitation of the hydrates, the wellhole is filled with water, at which the bottom pore pressure is equal to a gravity pressure of water; and after exploitation starts, the water will be pumped to a platform from the wellhole, and with a decrease in the water volume in the wellhole, the bottom pore pressure will decline gradually, thereby reducing the pressure in the reservoirs.

Preferably, the pressure decay amplitude at the bottoms of the wells ranges from 0.1 to 0.2 Mpa/h, and significant reduction in gas production refers to reduction of gas production to 1000 cubic meters/day below.

All aspects not fully described in the present invention can be referenced to the prior art.

The present invention has the following beneficial effects:

According to the present invention, during the exploitation of the natural gas hydrates across the sea area, seawater temperature at a sea level is higher, seawater can be supplied sufficiently and contains a certain salinity, and after being heated on the platform, the pumped seawater with the higher temperature is injected into the natural gas hydrate reservoirs along the first horizontal well; if the seawater temperature is lower, the measure of heating before injecting on the platform can be taken; the objective of heating the reservoirs can be fulfilled in a process that the injected seawater flows in fractures and pores of the natural gas hydrate reservoirs, and the temperature of the reservoirs is effectively maintained and elevated by making up heat absorbed from the decomposition of the natural gas hydrates in the reservoirs, and thus the gas recovery efficiency from the decomposition of the natural gas hydrates is further improved; and finally, the natural gas hydrates are decomposed into water and natural gases with the seawater injected into the reservoirs, which are recovered from the second horizontal well and the third horizontal well. According to the combined exploitation method of depressurization of the horizontal well and heat injection, the yield of the natural gases can be maintained at a higher level during the exploitation of the natural gas hydrates to meet the requirements of the commercial exploitation of the natural gas hydrates.

Figure 1:
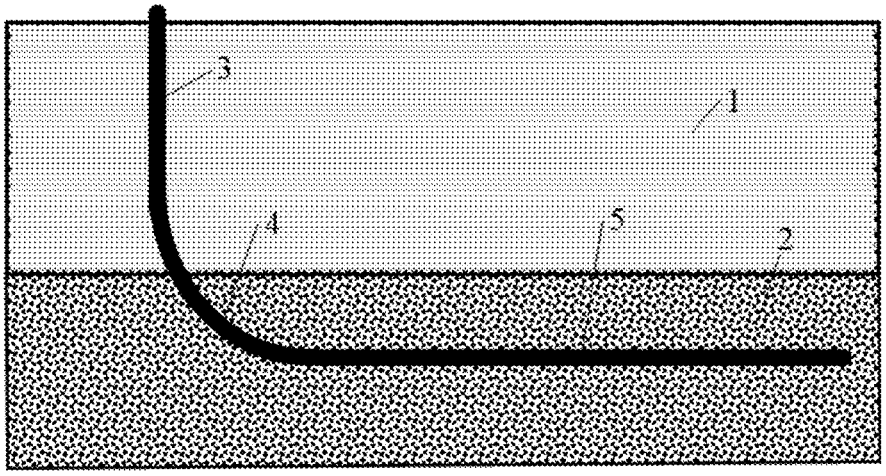
FIG. 1 is a schematic diagram of a horizontal well of natural gas hydrate reservoirs according to the present invention.
Figure 2:
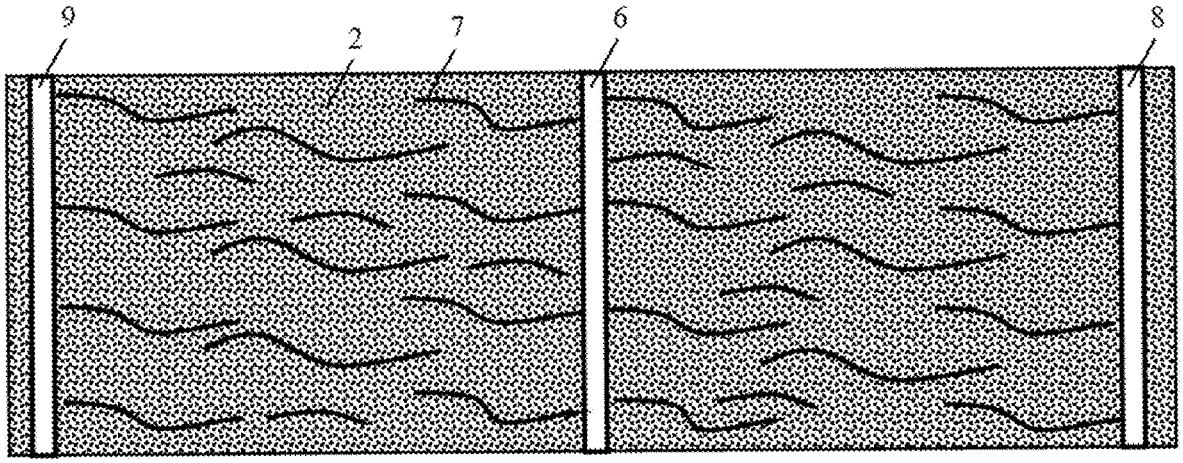
FIG. 2 is a schematic top view of an exploitation of natural gas hydrate reservoirs.

Illustrations of all the numerals: 1-Shallow stratum, 2-Natural gas hydrate reservoir, 3-Vertical well section, 4-Inclined well section, 5-Horizontal well section, 6-Horizontal well, 7-Fracture, 8-Second horizontal well, and 9-Third horizontal well.

DETAILED DESCRIPTION OF THE EMBODIMENTS

To make a person skilled in the art better understand the technical solutions of the present specification, the following describes the technical solutions of the present specification clearly and completely, but the present invention is not limited thereto. Any content not described in details in the present invention belongs to the conventional technology in the art.

Example 1

A high-efficiency yield-increasing exploitation method for natural gas hydrates includes the following steps:

drilling of natural gas hydrate reservoirs along horizontal wells

In view of an upper shallow stratum 1 above the deep-water natural gas hydrate reservoirs, featuring softness, and looseness, as for the natural gas hydrate reservoirs 2, drilling well arrays are drilled in an exploratory trench cycle drilling manner, each of which includes three horizontal wells: a first horizontal well 6, and a second horizontal well 8 and a third horizontal well 9 positioned on two sides of the first horizontal well 6, and each of the horizontal wells includes a vertical well section 3, an inclined well section 4, and a horizontal well section 5;

by the exploratory trench drilling manner, the drilling efficiency of single wells may be improved, and the drilling operation along the horizontal wells may increase a contact area between an exploitation wellhole and the reservoirs to improve the exploitation yield of the natural gas hydrates.

(1) seepage increasing by fracturing for fracture forming and stability improvement by grouting in the natural gas hydrate reservoirs After the drilling operation is completed, fracturing is implemented for fracture forming at the horizontal well section 5 of the first horizontal well 6, a seawater fracturing fluid is injected into the first horizontal well and flows into the natural gas hydrate reservoirs along the horizontal well section, so that fractures 7 are formed in the hydrate reservoirs between the first horizontal well and the second horizontal well, and between the first horizontal well and the third horizontal well to improve the permeability of such reservoirs, then, foam cement slurry is injected into the horizontal well section of the first horizontal well, is distributed all over the natural gas hydrate reservoirs, and is cured for forming for a period of time, thereby improving the stability of the hydrate reservoirs, and finally, a resin or oligomer chemical sand control agent which is commonly used in the art is injected into a periphery of the well to reduce or avoid a sand production rate during an exploitation of the natural gas hydrates at the later period and improve the safety of the natural gas hydrates in exploitation;

and in this step, the first horizontal well is designed as a fracturing well; the horizontal well section of the first horizontal well is fractured only in order to maintain the stability of the wellhole; seawater which is convenient to obtain, sufficient in supply, and low in costs serves as the fracturing fluid, with a fracturing pressure thereof being larger than a fracture forming pressure of the hydrate reservoirs, and the seawater fracturing fluid flows into the hydrate reservoirs along the horizontal well section of the first horizontal well, forming the fractures in the hydrate reservoirs between the first horizontal well and the second horizontal well and between the first horizontal well and the third horizontal well to improve the permeability of such reservoirs.

(2) Yield improvement by combined exploitation of depressurization of the horizontal well and heat injection The exploitation yield of the natural gas hydrates may be improved via the combined exploitation of depressurization of the horizontal well and heat injection, and in order to reduce the exploitation costs of the natural gas hydrates, seawater is injected into the natural gas hydrate reservoirs along the first horizontal well 6 at a temperature of more than 60° C. to elevate the reservoir temperature; and meanwhile, a pressure at bottoms of the second horizontal well 8 and the third horizontal well 9 is reduced, so as to improve a decomposition rate of the natural gas hydrates in the reservoirs under the collaborative action of the two operations.

According to the above-mentioned technical solution, drilling time is shortened by rapid drilling along the horizontal well, the permeability of the reservoirs may be effectively improved by fracturing for fracture forming, the stability of the reservoirs may be improved by injecting foam cement slurry into the reservoirs, and the yield of the natural gas hydrates may be improved by the combined exploitation method of depressurization of the horizontal well and heat injection. The method has the advantages of reducing drilling costs, improving the permeability of the reservoirs, enhancing the stability of the reservoirs, improving the gas recovery efficiency and the like.

Example 2

A high-efficiency yield-increasing exploitation method for natural gas hydrates is different from Example 1 in that in step (1), an interval among different horizontal wells is determined by the following method:

Firstly, based on a Darcy's law, a pressure distribution in natural gas hydrate reservoirs may be as follows:

$$P_2 = P_1 + \frac{Q \cdot \mu \cdot L}{K \cdot A} \tag{1}$$

where $P_1$ is a bottom pore pressure of the horizontal wells, MPa; $P_2$ is a pressure in the natural gas hydrate reservoirs, MPa; Q is a flow in pores of the natural gas hydrate reservoirs, $m^3/s$; μ is a fluid viscosity in the reservoirs, mPa·s; L is a seepage radius of a fluid in the reservoirs, m; K is an absolute permeability of the natural gas hydrate reservoirs, mD; A is a sectional area of seepage flow of the natural gas hydrate reservoirs, $m^2$;

then, in order to achieve a decomposition of the natural gas hydrates during an exploitation of the natural gas hydrates under reduced pressure, the pressure $P_2$ in the reservoirs needs to conform to the following criteria:

$$P_2 \le P_e = 10^6 \exp\left(\sum_{n=0}^{5} a_n (T + \Delta T_d)^n\right) \tag{2}$$

where $$\begin{cases} a_0 = -1.94138504464560 \times 10^5 \\ a_1 = 3.31018213397926 \times 10^3 \\ a_2 = -2.25540264493806 \times 10^1 \\ a_3 = 7.67559117787059 \times 10^{-2} \\ a_4 = -1.30465829788791 \times 10^{-4} \\ a_5 = 8.86065316687571 \times 10^{-8} \end{cases} \tag{3}$$

where T is a reservoir temperature, K; $\Delta T_d$ is a temperature at which a decline in a hydrate equilibrium is caused by a thermodynamic hydrate inhibitor, K;

$\Delta T_d$ may be obtained by the following formula through calculation:

$$\Delta T_d = \Delta T_{d,r} \frac{\ln(1-x)}{\ln(1-x_r)} \tag{4}$$

where x is a molar fraction of the thermodynamic hydrate inhibitor in a water phase, which is dimensionless; $x_r$ is a reference molar fraction of the thermodynamic hydrate inhibitor in the water phase, which is dimensionless; $\Delta T_{d,r}$ is a temperature at which the decline in the hydrate equilibrium is caused under the molar fraction of the thermodynamic hydrate inhibitor as $x_r$, K; and an interval ($L_1$=L) between every two horizontal wells is solved according to formulas (1)-(4), based on which the layout of the three horizontal wells is supported theoretically.

Example 3

A high-efficiency yield-increasing exploitation method for natural gas hydrates is different from Example 2 in that in step (2), during fracturing, a fracturing pressure is larger than a fracture forming pressure of the natural gas hydrate reservoirs.

In step (2), a preparation process of foam cement slurry is as follows:

a certain mass of cement is mixed with water to form cement slurry, and a certain mass of foaming agent (sodium dodecyl sulfate) and foam stabilizer (laurinol) are added to the cement slurry with stirring until fine and stable bubbles which are independent of each other are formed, and the foam cement slurry with low density and high permeability may be formed, with a density thereof being less than 1.0 $g/cm^3$, which needs, however, to be determined according to actual design and requirements on site, that is, $\rho_{gfc}$ in the formula (5). The construction method is readily available, without arranging any additional equipment, and the formed foam cement slurry has the advantages of stable properties, high compressive strength, low costs, and the like. What there will be to adopt in the construction method is thinner foam cement slurry. This may improve the liquidity of the foam cement slurry in the reservoirs, making it distributed all over the pores of the reservoirs better.

In the preparation of the foam cement slurry, according to the properties of the required foam cement slurry and a mix proportioning principle thereof, the using amount of the cement is as follows:

$$M_{sn} = \frac{V_{gfc} \cdot \rho_{gfc}}{s_a} \tag{5}$$

where $M_{sn}$ is the using amount of the cement, kg; $\rho_{gfc}$ is the design dry density of the foam cement, $kg/m^3$; V g fc is the volume of the dry foam cement, $m^3$; $S_a$ is a mass coefficient, which is dimensionless, wherein it is 1.2 for ordinary Portland cement, and 1.4 for sulfate cement;

water supply volume:

$$M_w = \alpha \cdot M_{sn} \tag{6}$$

where $M_{sn}$ is the water supply volume; a is a basic ratio of water to materials, which is dimensionless;

the using amount of the foaming agent:

$$M_p = \frac{V_{py} \cdot \rho_{py}}{b+1} \tag{7}$$

where $M_p$ is the mass of the foaming agent in the foam cement slurry, kg; $V_{py}$ is the volume of a foam concentrate formed from the foaming agent, $m^3$; $\rho_{py}$ is the density of the foam concentrate formed from the foaming agent, $kg/m^3$; b is the times of foaming of the foaming agent, which is dimensionless; and the using amount of the foam stabilizer is half of that of the foaming agent.

The injection rate of the foam cement slurry is as follows:

$$V_{fc} \ge 2L_1 \cdot L_2 \cdot H \cdot S_f \tag{8}$$

where $V_{fc}$ is a volume of the foam cement slurry to be injected into the natural gas hydrate reservoirs, $m^3$; $L_2$ is a length of the horizontal well section, m; H is a thickness of the natural gas hydrate reservoirs, m; and $S_f$ is a porosity of the natural gas hydrate reservoirs subjected to fracturing for fracture forming, which is dimensionless.

Example 4

A high-efficiency yield-increasing exploitation method for natural gas hydrates is different from Example 3 in that in step (2), during the injection of foam cement slurry into the horizontal well section of the first horizontal well, when it is found that there is the foam cement slurry in the second horizontal well and the third horizontal well, the injection of the foam cement slurry may be stopped, and meanwhile, the foam cement slurry is removed rapidly from the second horizontal well and the third horizontal well, that is, clear water may be injected into drill stems in the second horizontal well and the third horizontal well, the foam cement slurry carried thereby returns upwards from an annular space between the drill stems and drivepipes to fulfill the objective of cleaning; and then, each of the horizontal wells is shut in for 48 h, until the foam cement slurry injected into the natural gas hydrate reservoirs is cured for forming, which may improve the stability of the reservoirs during the exploitation of the natural gas hydrates and reduce risks of the collapse and sand production of the natural gas hydrate reservoirs.

Example 5

A high-efficiency yield-increasing exploitation method for natural gas hydrates is different from Example 4 in that, in step (3), the pressure distributed in the reservoirs is reduced by controlling a pressure decay amplitude at the bottoms of the second horizontal well and the third horizontal well, so that the natural gas hydrates in the reservoirs are decomposed into gases and water, and meanwhile, and the gases flow into the second horizontal well and the third horizontal well under a differential pressure for recovery In order to solve the problem of the secondary generation of the hydrates due to the rapid decomposition of the natural gas hydrates for a short time in the reservoirs, a relationship between absorption of heat from the decomposition of the hydrates and a heat transfer around the reservoirs is coordinated by controlling the bottom hole pressure of the second horizontal well and the third horizontal well with a multi-stage step-by-step depressurization strategy, that is, the pressure decay amplitude at the bottoms of the wells is reduced slowly after the bottom hole pressure is reduced to a hydrate phase equilibrium condition in decomposition, ranging from 0.1 to 0.2 MPa, and with every 0.5 MPa of the bottom hole pressure declining, a bottom hole pressure value is maintained until a gas recovery rate declines significantly (i.e., declining to 1000 cubic meters/day below) before the depressurization of the next step, thereby fulfilling the objective of reducing or avoiding the secondary generation risk of the hydrates in the reservoirs.

A method for reducing the bottom pore pressure is as follows:

Before the exploitation of the hydrates, the wellhole is filled with water, at which the bottom pore pressure is equal to a gravity pressure of water; and after exploitation starts, the water will be pumped to a platform from the wellhole, and with a decrease in the water volume in the wellhole, the bottom pore pressure will decline gradually, thereby reducing the pressure in the reservoirs.

The above descriptions are only preferred implementations of the prevent invention, and it should be noted that a person of ordinary skill in the art can further make several improvements and modifications without departing from the principle of the present invention, and those improvements and modifications should be included in the protection scope of the present disclosure.

What is claimed is:

1. A high-efficiency yield-increasing exploitation method for natural gas hydrates, comprising the following steps:

(i) drilling of natural gas hydrate reservoirs along horizontal wells as for the natural gas hydrate reservoirs, drilling well arrays in an exploratory trench drilling manner along the horizontal wells, each of which comprising three horizontal wells: a first horizontal well, and a second horizontal well and a third horizontal well positioned on two sides of the first horizontal well, and each of the horizontal wells comprising a vertical well section, an inclined well section, and a horizontal well section;

(ii) seepage increasing by fracturing for fracture forming and stability improvement by grouting in the natural gas hydrate reservoirs after completing a drilling operation, implementing fracturing for fracture forming at the horizontal well section of the first horizontal well, injecting a seawater fracturing fluid into the first horizontal well, and allowing the seawater fracturing fluid to flow into the natural gas hydrate reservoirs along the horizontal well section, so that fractures are formed in the hydrate reservoirs between the first horizontal well and the second horizontal well, and between the first horizontal well and the third horizontal well, then, injecting foam cement slurry into the horizontal well section of the first horizontal well, allowing the foam cement slurry to be distributed all over the natural gas hydrate reservoirs, and curing for forming, and finally, injecting a resin or oligomer chemical sand control agent into a periphery of the well to reduce or avoid a sand production rate during an exploitation of the natural gas hydrates at a later period; and (iii) yield improvement by combined exploitation of depressurization of the horizontal wells and heat injection injecting seawater into the natural gas hydrate reservoirs along the first horizontal well at a temperature of above 60° C., and meanwhile, reducing a bottom pore pressure of the second horizontal well and the third horizontal well, so as to improve a decomposition rate of the natural gas hydrates in the reservoirs under a collaborative action of the two operations.

2. The high-efficiency yield-increasing exploitation method for the natural gas hydrates according to claim 1, wherein in step (i), an interval among different horizontal wells is determined in the following method:

firstly, based on a Darcy's law, a pressure distribution in the natural gas hydrate reservoirs is as follows:

$$P_2 = P_1 + \frac{Q \cdot \mu \cdot L}{K \cdot A} \tag{1}$$

wherein $P_1$ is a bottom pore pressure of the horizontal wells, MPa; $P_2$ is a pressure in the natural gas hydrate reservoirs, MPa; Q is a flow in pores of the natural gas hydrate reservoirs, $m^3/s$; μ is a fluid viscosity in the reservoirs, mPa·s; L is a seepage radius of a fluid in the reservoirs, m; K is an absolute permeability of the natural gas hydrate reservoirs, mD; A is a sectional area of seepage flow of the natural gas hydrate reservoirs, $m^2$;

then, in order to achieve a decomposition of the natural gas hydrates during an exploitation of the natural gas hydrates under reduced pressure, the pressure $P_2$ in the reservoirs needs to conform to the following criteria:

$$P_2 \le P_e = 10^6 \exp\left(\sum_{n=0}^{5} a_n (T + \Delta T_d)^n\right) \tag{2}$$

wherein $$\begin{cases} a_0 = -1.94138504464560 \times 10^5 \\ a_1 = 3.31018213397926 \times 10^3 \\ a_2 = -2.25540264493806 \times 10^1 \\ a_3 = 7.67559117787059 \times 10^{-2} \\ a_4 = -1.30465829788791 \times 10^{-4} \\ a_5 = 8.86065316687571 \times 10^{-8} \end{cases} \tag{3}$$

wherein T is a reservoir temperature, K; $\Delta T_d$ is a temperature at which a decline in a hydrate equilibrium is caused by a thermodynamic hydrate inhibitor, K;

$\Delta T_d$ is obtained by the following formula through calculation:

$$\Delta T_d = \Delta T_{d,r} \frac{\ln(1-x)}{\ln(1-x_r)} \tag{4}$$

wherein x is a molar fraction of the thermodynamic hydrate inhibitor in a water phase, which is dimensionless; $x_r$ is a reference molar fraction of the thermodynamic hydrate inhibitor in the water phase, which is dimensionless; $\Delta T_{d,r}$ is a temperature at which the decline in the hydrate equilibrium is caused under the molar fraction of the thermodynamic hydrate inhibitor as $x_r$, K; and an interval ($L_1$=L) between every two horizontal wells is solved according to formulas (1)-(4).

3. The high-efficiency yield-increasing exploitation method for the natural gas hydrates according to claim 1, wherein in step (ii), during fracturing, a fracturing pressure is larger than a fracture forming pressure of the natural gas hydrate reservoirs.

4. The high-efficiency yield-increasing exploitation method for the natural gas hydrates according to claim 3, wherein in step (ii), a preparation process of the foam cement slurry is as follows:

mixing a certain mass of cement with water to form cement slurry, and adding a certain mass of foaming agent and foam stabilizer to the cement slurry with stirring to form foam cement slurry;

in the preparation of the foam cement slurry, according to the properties of the required foam cement slurry and a mix proportioning principle thereof, the using amount of the cement is as follows:

$$M_{sn} = \frac{V_{gfc} \cdot \rho_{gfc}}{s_a} \tag{5}$$

wherein $M_{sn}$ is the using amount of the cement, kg; $\rho_{gfc}$ is the design dry density of the foam cement, kg/m$^3$; $V_{gfc}$ is the volume of the dry foam cement, m$^3$; $S_a$ is a mass coefficient, which is dimensionless, wherein the mass coefficient is 1.2 for ordinary Portland cement, and 1.4 for sulfate cement;

water supply volume:

$$M_w = \alpha \cdot M_{sn} \tag{6}$$

wherein $M_w$ is the water supply volume; a is a basic ratio of water to materials, which is dimensionless;

the using amount of the foaming agent:

$$M_p = \frac{V_{py} \cdot \rho_{py}}{b+1} \tag{7}$$

wherein $M_p$ is the mass of the foaming agent in the foam cement slurry, kg; $V_{py}$ is the volume of a foam concentrate formed from the foaming agent, m$^3$; $\rho_{py}$ is the density of the foam concentrate formed from the foaming agent, kg/m$^3$; b is the times of foaming of the foaming agent, which is dimensionless; and the using amount of the foam stabilizer is half of that of the foaming agent.

5. The high-efficiency yield-increasing exploitation method for the natural gas hydrates according to claim 4, wherein in step (ii), an injection rate of the foam cement slurry is as follows:

$$V_{fc} \ge 2L_1 \cdot L_2 \cdot H \cdot S_f \tag{8}$$

wherein $V_{fc}$ is a volume of the foam cement slurry to be injected into the natural gas hydrate reservoirs, m$^3$; $L_2$ is a length of the horizontal well section, m; H is a thickness of the natural gas hydrate reservoirs, m; and $S_f$ is a porosity of the natural gas hydrate reservoirs subjected to fracturing for fracture forming, which is dimensionless.

6. The high-efficiency yield-increasing exploitation method for the natural gas hydrates according to claim 5, wherein in step (ii), during the injection of the foam cement slurry into the horizontal well section of the first horizontal well, when the foam cement slurry is found in the second horizontal well and the third horizontal well, the injection of the foam cement slurry should be stopped, and meanwhile, the foam cement slurry is removed rapidly from the second horizontal well and the third horizontal well; and then, each of the horizontal wells is shut in for 48 h, until the foam cement slurry injected into the natural gas hydrate reservoirs is cured for forming.

7. The high-efficiency yield-increasing exploitation method for the natural gas hydrates according to claim 6, wherein in step (iii), the pressure distributed in the reservoirs is reduced by controlling a pressure decay amplitude at the bottoms of the second horizontal well and the third horizontal well, so that the natural gas hydrates in the reservoirs are decomposed into gases and water, and meanwhile, and the gases flow into the second horizontal well and the third horizontal well under a differential pressure for recovery; and a relationship between absorption of heat from the decomposition of the hydrates and a heat transfer around the reservoirs is coordinated by controlling the bottom pore pressure of the second horizontal well and the third horizontal well with a multi-stage step-by-step depressurization strategy, that is, the pressure decay amplitude at the bottoms of the wells is reduced after the bottom pore pressure is reduced to a hydrate phase equilibrium condition in decomposition, and with every 0.5 MPa of the bottom pore pressure declining, a bottom pore pressure value is maintained until a gas recovery rate declines significantly before the depressurization of the next step.

8. The high-efficiency yield-increasing exploitation method for the natural gas hydrates according to claim 7, wherein the pressure decay amplitude at the bottoms of the wells ranges from 0.1 to 0.2 Mpa/h, and significant reduction in gas recovery rate refers to reduction of gas recovery rate to 1000 cubic meters/day below.

9. The high-efficiency yield-increasing exploitation method for the natural gas hydrates according to claim 4, wherein the foaming agent is preferably sodium dodecyl sulfate, and the foam stabilizer is preferably laurinol.

* * * * *